US005197360A

United States Patent [19]

Wooster, Jr.

[11] Patent Number: 5,197,360

[45] Date of Patent: Mar. 30, 1993

[54] ADJUSTABLE CLAMP

[75] Inventor: Robert D. Wooster, Jr., Crystal Lake, Ill.

[73] Assignee: Adjustable Clamp Co., Chicago, Ill.

[21] Appl. No.: 841,719

[22] Filed: Feb. 28, 1992

[51] Int. Cl.[5] ..... B25B 5/02

[52] U.S. Cl. ..... 81/487; 269/170

[58] Field of Search ..... 81/152, 150, 487; 269/6, 165, 166-170, 900

[56] References Cited

U.S. PATENT DOCUMENTS

| | | | |
|---|---|---|---|
| 1,783,713 | 12/1930 | Holman . | |
| 2,574,227 | 11/1951 | Sarvie | 81/152 |
| 2,815,778 | 12/1957 | Holman . | |
| 4,926,722 | 5/1990 | Sorensen et al. . | |
| 4,989,847 | 2/1991 | Chapman . | |
| 5,005,449 | 4/1991 | Sovensen et al. | 81/152 |
| 5,009,134 | 4/1991 | Sorensen et al. . | |
| 5,094,131 | 3/1992 | Sorensen et al. | 81/152 |

OTHER PUBLICATIONS

Popular Science, Aug. 1989, p. 79.

*Primary Examiner*—Roscoe V. Parker

*Attorney, Agent, or Firm*—Lockwood, Alex, FitzGibbon & Cummings

[57] ABSTRACT

A bar clamp having one of its jaws mounted on a jaw carrier which is slidable on the bar and which may be manually shifted thereon in one direction by releasing a brake key or keys and manually shifted in the opposite direction by manipulating a jaw carrier drive mechanism, the brake key or keys and the drive mechanism being alternately operable by holding the clamp in one hand. In its preferred form, the one-hand manipulatable drive mechanism is attachable to a commercially available bar clamp made according to Holman U.S. Pat. No. 2,815,778 dated Dec. 10, 1957. The drive mechanism includes a drive lever having an apertured portion which is pivotal on the bar and a handle, an apertured drive lever brake key juxtaposed to apertured portion of the drive lever, a compression spring slidable on the bar with one end engaging the drive lever brake key, and a retainer having one part which engages the other end of the spring and another part which is attachable to jaw carrier and holds the spring in a compressed condition biasing the apertured portion of the drive lever against the jaw carrier.

9 Claims, 3 Drawing Sheets

ADJUSTABLE CLAMP

BACKGROUND AND DESCRIPTION OF THE INVENTION

This invention relates generally to improvements in bar clamps of the portable type in which one of the jaws is usually fixed on one end of the bar and the opposing or cooperating jaw is slidable on the bar toward and away from the fixed jaw. More particularly, the invention relates to such a bar clamp which is adapted to be held in one hand and which has a mechanism for shifting the non-fixed jaw toward the fixed jaw via manipulating the lever on a jaw driving or advancing mechanism.

In its preferred form, the invention relates to a jaw shifting or driving mechanism which may be attached to a commercially available bar clamp to provide a one-hand operable tool in which the shiftable or movable jaw can be advanced or driven by gripping and releasing a lever handle and in which the shiftable jaw can be freed to shift away from the fixed jaw by releasing a brake key.

A bar clamp which requires two hands to manipulate, and which has been commercially available for a number of years, is disclosed in U.S. Pat. No. 2,815,778 dated Dec. 10, 1957 and assigned to Adjustable Clamp Company of Chicago, Ill. Bar clamps which are more or less operable with one hand are disclosed in U.S. Pat. No. 4,926,722 dated Aug. 19, 1988 and U.S. Pat. No. 4,989,847 dated Feb. 5, 1991.

The object of the present invention, generally stated, is the provision of an improved bar clamp that can be operated with one hand. An important and more particular object of the invention is the provision of a mechanism that can be attached to the bar clamp shown and disclosed in U.S. Pat. No. 2,815,778 which converts that bar clamp into a one-hand operable bar clamp. The drive mechanism of the present invention may be readily installed on commercially available bar clamps made pursuant to the disclosure of U.S. Pat. No. 2,815,778.

For a more complete understanding of the nature and scope of the invention, reference may now be had to the following detailed description thereof taken in connection with the accompanying drawings, wherein:

FIG. 1 is a side elevational view of a bar clamp illustrating the prior art and which corresponds to FIG. 1 of U.S. Pat. No. 2,815,778;

Figure 1:
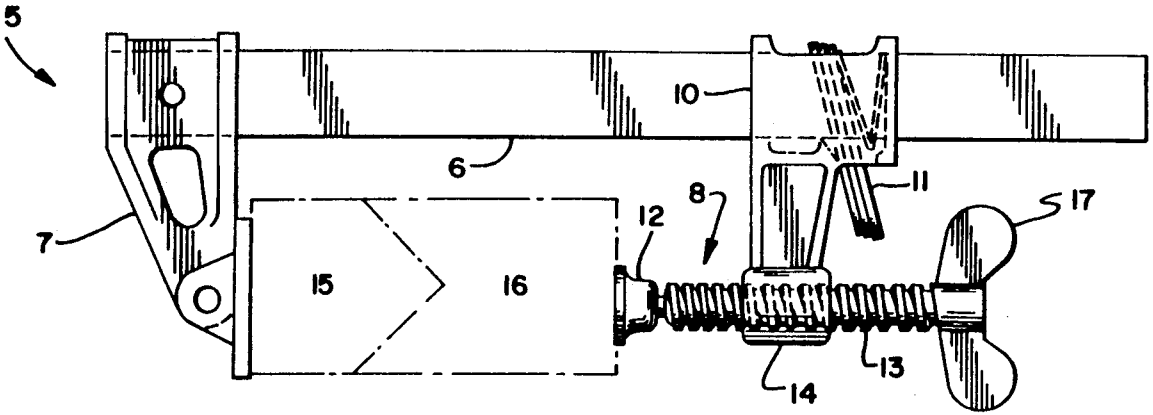
FIG. 1 PRIOR ART

In FIG. 1, a prior art clamp is indicated generally at 5 comprising a bar 6 on which a fixed jaw 7 is mounted at one end and on which a movable jaw indicated generally at 8 is mounted on a jaw carrier 10. The jaw carrier 10 is apertured so as to be slidable on the bar 6 and contains therein three apertured brake keys collectively indicated at 11—11. A V-spring is lodged in the carrier 10 so as to maintain the keys 11 in a tilted position gripping the bar 6. The keys 11 allow the carrier 10 to be manually moved or shifted toward the fixed jaw 7 when the clamp 5 is empty but prevent the jaw carrier 10 from moving away from the fixed jaw 7. However, by manually tilting the brake keys to a more vertical condition, they relax their grip on the bar 6 and allow it to be manually moved away from the fixed jaw 7.

It will be seen that the movable jaw 8 is in the form of a work-engaging part 12 swivelly mounted on the end of the screw 13 carried by the internally threaded boss 14.

The normal manner of use of the bar clamp 5 is well understood. A pair of work pieces 15 and 16 to be clamped together are inserted between the jaws 7 and 8 as shown and then the screw 13 is tightened by turning the end piece 17 so as to tighten the part 12 against the side of the work piece 16.

It will be seen that two hands are required in order to operate or manipulate the clamp 5 of FIG. 1. There are occasions when it is desirable to be able to operate such a bar clamp by means of one hand. In accordance with this invention, the bar clamp 5 of FIG. 1 can be converted into a one-hand operable bar clamp by attaching a jaw drive mechanism. Such a converted one-hand operable bar clamp is indicated generally at 20 in FIGS. 2–6 to which reference is now made.

Figure 2:
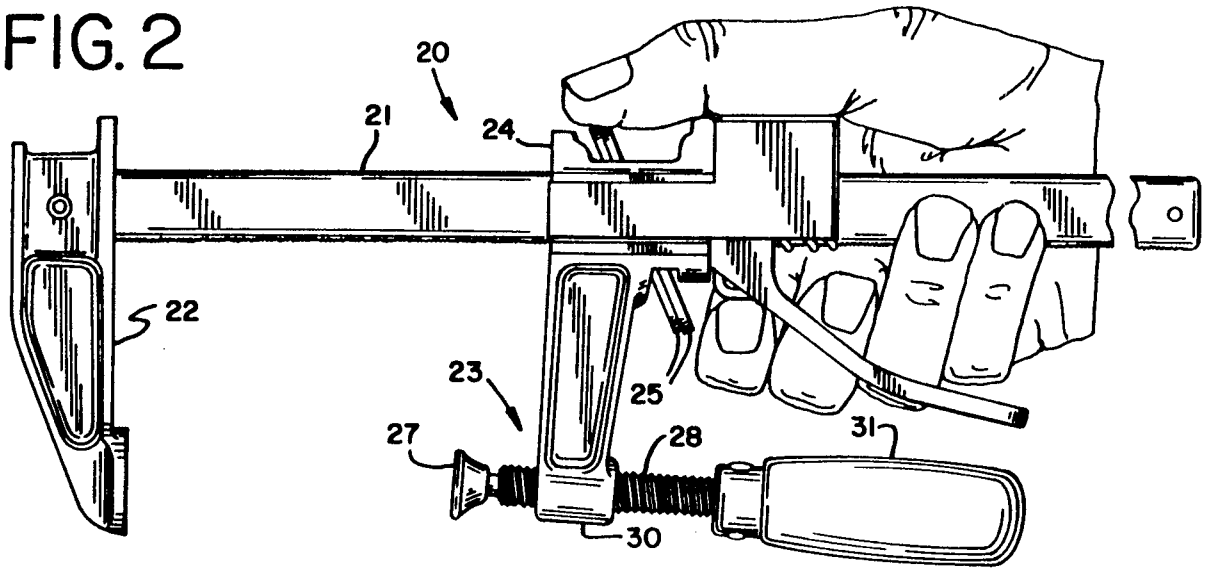
FIG. 2 is a side elevational view of a one-hand operable bar clamp embodying the present invention with the hand of a user shown in position to release the brake which prevents the movable jaw of the clamp from moving away from the fixed jaw.

The bar clamp 20 comprises a bar 21 on one end of which a fixed jaw 22 is mounted with the opposing jaw indicated generally at 23 being carried by a jaw carrier 24. The jaw carrier 24 is apertured so as to be slidable on the bar 21 and is formed with a pocket in which a pair of jaw carrier brake keys 25–25 are mounted. The brake keys 25 are apertured so as to be slidable and tiltable on the bar 21. A V-spring 26 is also mounted in the pocket in the jaw carrier 24 and acts to tilt and bias the apertured keys 25 into their bar gripping position shown in FIGS. 2–6. In this position, the bottom edges of the apertures in the keys 25 engage the serrations 27 in the underside of the bar 21 and brake the jaw carrier 24 from being shifted away from the jaw 22. However, the tilted brake keys 25 do not prevent the jaw carrier 24 from being shifted toward the jaw 22. The braking action of the keys 25 can be released by manually tilting the brake keys 25 toward an upright position by the clamp users thumb and/or index finger as illustrated in FIG. 2.

The jaw 23 is adjustable and includes the jaw part 27 with a swivel mounting on the end of the screw 28 mounted in the internally threaded boss 30. As is well understood, final clamping pressure is obtained by rotating the screw 28 by means of its handle 31.

The construction of the bar clamp 20 as thus far described corresponds to the construction of the prior art bar clamp 5 described above in connection with FIG. 1. However, by attaching to the jaw carrier 24 a driving mechanism indicated generally at 32, the bar clamp 20 may be converted to a one-hand operable bar clamp.

Figure 6:
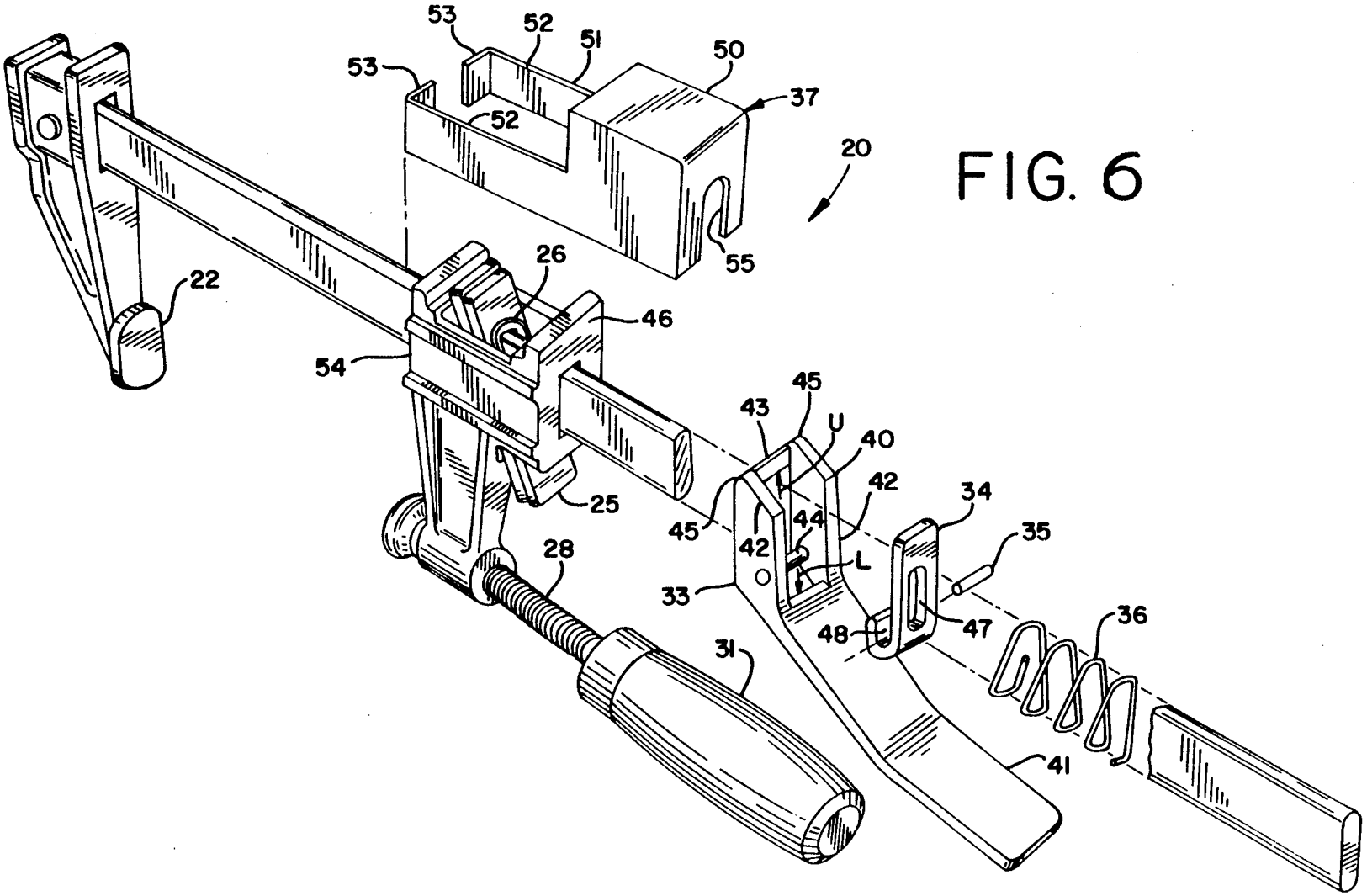
FIG. 6 is a perspective exploded view showing the components of the clamp shown in FIGS. 2–5.

The components of the jaw carrier drive mechanism 32 are shown in perspective in FIG. 6. These components include a drive lever indicated generally at 33, an apertured drive lever brake key 34, a roll pin 35, a compression string 36 and a retainer indicated generally at 37.

The drive lever 33 has an apertured portion 40 and an operating handle 41. The apertured portion 40 is formed with two parallel sides 42—42 interconnected at the top by the integral connector or strut 43. A pin 44 extends between the sides 42 adjacent their bottom edges.

The length of the aperture or opening in the lever portion 40 is indicated in FIG. 6 by the upper and lower arrows U and L, respectively, indicating the upper and lower edges, respectively, of the opening. In the particular construction shown, the opening suffices to permit the drive lever 33 to tilt through an angle of approximately 30 degrees in operation.

When the components of the drive mechanism 32 are fully assembled on the bar 21 and jaw carrier 24, the rounded off strut 43 and corners 45–45 at the tops of the sides 42 have a cam-like engagement with the vertical surface 46 (FIG. 6) of the jaw carrier 24.

Figures 3, 4, 5:
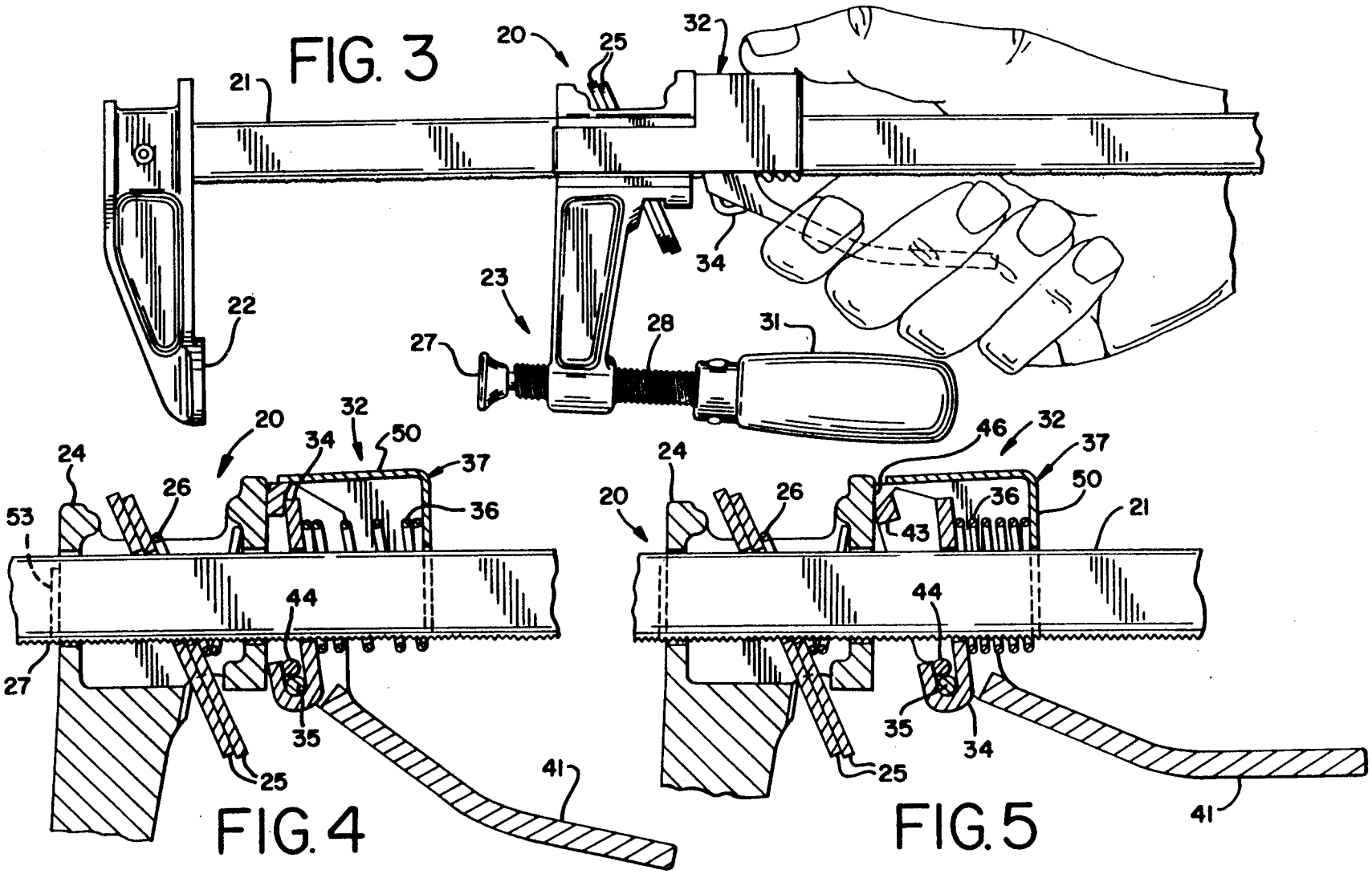
FIG. 3 is a side elevational view corresponding to FIG. 2 but showing the position of the hand of the user in operating the drive mechanism to shift the movable jaw towards the fixed jaw.
FIG. 4 is a fragmentary view partly in vertical section and partly in elevation showing the condition of the components of the drive mechanism in their normal non-operating condition.
FIG. 5 is a fragmentary view corresponding to FIG. 4 but showing the components of the drive mechanism at the end of an advancing stroke of the mechanism.

The drive lever brake key 34 is J-shaped and is apertured so as to be slidable on the bar 21 and tiltable with respect thereto so that the bottom of the aperture 47 (FIG. 6) therein will have a gripping action with respect to the serrated bottom edge of the bar 21. The reverse bend on the bottom of the key 34 provides a pocket 48 for receiving the pin 35 and also the pin 44 as shown in FIGS. 4 and 5. While the pin 35 is not essential, it contributes to the smooth pivoting action of the lever 33 in operation.

The compression spring 36 is freely slidable on the bar 21 and in assembled relationship its leading end engages the drive lever brake key 34 as illustrated in FIGS. 4 and 5.

The components of the jaw carrier drive mechanism 32 are maintained in assembled relationship and connected to the jaw carrier 24 by means of the retainer 37. This component comprises a box-like housing 50 and a clip-like attaching portion 51. While the retainer 37 may be formed from various metals and plastics, it is preferably formed from a steel stamping which may be readily shaped and formed. The attaching portion 51 takes the form of a pair of opposing clip arms 52—52 with opposing inturned ends 53—53. The width of the arms 52 is such that they will readily fit in the grooves 54 (FIG. 6) formed in opposite sides of the jaw carrier 24. Preferably, the material from which the retainer 37 is formed will impart a sufficient spring action to the arms 52 so that they may be spread apart so as to attach the retainer 37 to the jaw carrier 24 and upon release, the arms 52 will spring back into the grooves 54 while the inturned ends 53 will engage the side of the jaw carrier 24 opposite the side 46.

It will be seen that when the components of the jaw carrier drive mechanism are assembled within the housing 50, the vertical slot opening 55 of the housing will fit over the bar 21 and the spring 36 will be maintained under compression as shown in FIGS. 4 and 5.

With the handle 41 released, the spring 36 will maintain the components in their relative positions indicated in FIG. 4. The inturned ends 53 on the retainer 37 act to maintain the spring under compression within the housing 50.

In use and operation the bar clamp 20 may be grasped and held in one hand as illustrated in FIG. 3 with the user's thumb on the top resting on the top of the housing 50 and the fingers grasping the lever 41 from the underside. On operating the handle 41 so as to move it to its uppermost position, the components of the drive mechanism 32 will assume the position shown in FIG. 5. When the upper movement of the handle 41 begins, the bottom edge of the aperture 47 in the lever brake 34 will grip or bite into the serrated bottom edge of the bar 31 so as to brake the apertured portion 40 of the drive lever from sliding or moving rearwardly or to the right as viewed in FIGS. 2–5 with respect to the bar 21. As the lever handle 41 is moved upwardly, its pin 44 will rotate on the pin 35 and the corners 45 and strut 43 will move downwardly and forwardly through an arc (to the left as viewed in FIG. 5) against the surface 46 of the jaw carrier 24 thereby forcing the jaw carrier to slide forwardly towards the fixed jaw 22. The forward motion of the jaw carrier 24 will cause the retainer 37 to also move forward and place the spring 36 in its compressed condition as shown in FIG. 5. Upon release of the handle 41 the parts will resume the condition shown in FIG. 4. By repeating the upward movement of the handle 41, the step-wise advancing action will be repeated and the jaw carrier 24 can thus be advanced by increments toward the fixed jaw 22.

It will be understood that changes in design details may be made without departing from the spirit and scope of the invention as defined in the appended claims. For example, instead of the strut or bar 43 being integral with the sides 42 it may be replaced by a pin extending through the sides which will serve as a stop for the upper end of the drive lever brake key 34. Likewise, the pin 44 may be a separate part as shown or integral with the sides 42.

What is claimed is:

1. In a bar clamp having a bar and a pair of opposed work-engaging jaws mounted thereon with at least one of the jaws mounted on a jaw carrier slidable on the bar, at least one jaw carrier brake key apertured for both sliding and tilting movement on the bar and mounted on the bar in braking relationship with said jaw carrier; and spring means biasing said jaw carrier brake key into a tilted braking position on the bar in which it grips the bar and brakes the jaw carrier against sliding movement in one direction on the bar while permitting said jaw carrier to slide on the bar in the opposite direction, said jaw carrier brake key being manually tiltable so as to temporarily release its grip on the bar, the improvement which comprises, a one-way jaw carrier drive mechanism comprising, a jaw carrier drive lever having an apertured jaw carrier drive portion slidably and tiltably mounted on the bar independently of said jaw carrier and an operating handle, an apertured carrier drive lever brake key tiltably disposed on the bar in braking relationship with said apertured jaw carrier drive portion, a compression spring surrounding the bar and slidable thereon with one end engageable with said carrier drive lever brake key, and a compression spring retainer having a portion which engages the end of said compression spring opposite said first-mentioned one end thereof and an attaching portion which removably attaches said retainer to said jaw carrier and retains said compression spring in a compressed condition against said carrier drive lever brake key and thereby biases said apertured jaw carrier drive portion of said jaw carrier drive lever against said jaw carrier, said apertured jaw carrier drive portion being pivotable on the bar by means of its operating handle between a non-operating position into which it is biased by said compression spring and pivoted driving positions in which it drives said jaw carrier to shift on the bar, the compression spring biasing said carrier drive lever brake key into a tilted gripping relationship with the bar in which it brakes said jaw carrier drive lever from shifting o the bar when said jaw carrier drive lever is in its pivoted driving positions, said bar clamp being operable as a bar clamp when said jaw carrier drive lever, said apertured carrier drive lever brake key, said compression spring and said compression spring retainers are removed therefrom.

2. In the bar clamp called for in claim 1, said apertured jaw carrier drive portion of said jaw carrier drive lever having a pin extending transversely across the lower part of the aperture therein so as to engage the lower portion of said apertured carrier drive lever brake key and tilt it into braking relationship with the bar when said handle is moved toward the bar.

3. In the bar clamp called for in claim 2, said apertured carrier drive lever brake key being J-shaped with the hook portion thereof providing a pocket in which a second pin is located in engagement with said first mentioned pin.

4. In the bar clamp called for in claim 1, wherein the transverse end of said apertured jaw carrier drive portion of said jaw carrier remote from said operating handle has camming engagement with said jaw carrier and causes said jaw carrier to move away from said apertured carrier drive brake key when said jaw carrier drive lever is pivoted with respect to the bar.

5. In the bar clamp of claim 1, said portion of said spring retainer which engages said compression spring being in the form of a housing which houses at least major portions of said compression spring, said apertured jaw carrier drive portion of said jaw carrier drive lever and said apertured carrier drive lever brake key.

6. In the bar clamp of claim 1, said attaching portion of said compression spring retainer being in the form spaced arms which engage lateral sides of said jaw carrier and which have inturned distal ends that engage said jaw carrier on the side opposite to the side thereof on which said carrier drive mechanism is disposed.

7. In the bar clamp of claim 6, spaced arm-receiving grooves in the lateral sides of said jaw carrier and having spring action toward each other which keeps the arms in place in said grooves and which permits said jaw carrier drive mechanism to be releasably attached to said jaw carrier.

8. The bar clamp of claim 1 wherein said clamp may be held in and operated by one hand simultaneously grasping said bar and operating handle.

9. The bar clamp of claim 1 wherein said clamp may be held by one hand while using that hand to release said jaw carrier brake key.

* * * * *